US009972258B2

(12) United States Patent
Chen

(10) Patent No.: US 9,972,258 B2
(45) Date of Patent: May 15, 2018

(54) DRIVING METHODS OF POLARITY INVERSION OF LIQUID CRYSTAL PANELS

(71) Applicant: Shenzhen China Star Optoelectronics Technology Co., Ltd., Shenzhen, Guangdong (CN)

(72) Inventor: Lixuan Chen, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 144 days.

(21) Appl. No.: 14/778,923

(22) PCT Filed: Aug. 31, 2015

(86) PCT No.: PCT/CN2015/088515

§ 371 (c)(1),
(2) Date: Sep. 21, 2015

(87) PCT Pub. No.: WO2016/201791

PCT Pub. Date: Dec. 22, 2016

(65) Prior Publication Data

US 2017/0140721 A1 May 18, 2017

(30) Foreign Application Priority Data

Jun. 19, 2015 (CN) ..... 2015 1 0344787

(51) Int. Cl.
*G09G 3/36* (2006.01)

(52) U.S. Cl.
CPC ..... *G09G 3/3614* (2013.01); *G09G 3/3607* (2013.01); *G09G 2310/0243* (2013.01); *G09G 2310/0289* (2013.01)

(58) Field of Classification Search
CPC ..... G09G 3/3614; G09G 3/3607; G09G 2310/0243; G09G 2310/0289; G09G 3/3648
See application file for complete search history.

(56) References Cited

U.S. PATENT DOCUMENTS

2008/0252624 A1* 10/2008 Jang ..... G09G 3/3648 345/204
2010/0123702 A1* 5/2010 Kim ..... G09G 3/3614 345/211

(Continued)

FOREIGN PATENT DOCUMENTS

CN 101424805 A 5/2005
CN 1940686 A 4/2007

(Continued)

*Primary Examiner* — Richard Hong
(74) *Attorney, Agent, or Firm* — Andrew C. Cheng

(57) ABSTRACT

A driving method of polarity inversion of liquid crystal panels includes driving sub-pixels within a predetermined area of the liquid crystal panel by a period having m number of consecutive frames, and m is an integer larger than four. Wherein polarity of sub-pixel driving voltage of a first predetermined number of consecutive frames among the m number of frames are the same, and the polarity of the sub-pixel driving voltage of the frames other than the first predetermined number of consecutive frames is opposite to the polarity of the sub-pixel driving voltage of the adjacent frames. With such configuration, the IS issue when displaying images by the liquid crystal panel may be eliminated.

7 Claims, 1 Drawing Sheet

(56) References Cited

U.S. PATENT DOCUMENTS

| | | | | |
|---|---|---|---|---|
| 2011/0050753 | A1* | 3/2011 | Li | G09G 3/3614 345/690 |
| 2012/0299884 | A1* | 11/2012 | Liu | G09G 3/3614 345/204 |
| 2014/0176411 | A1* | 6/2014 | Yang | G09G 3/3614 345/96 |
| 2016/0196789 | A1* | 7/2016 | Suyama | G09G 3/3614 345/209 |

FOREIGN PATENT DOCUMENTS

| | | | |
|---|---|---|---|
| CN | 102629453 | A | 8/2012 |
| CN | 102842295 | A | 12/2012 |
| CN | 104106110 | A | 12/2012 |
| CN | 103021366 | A | 4/2013 |
| WO | WO2014103912 | A1 | 7/2014 |
| WO | PCT/CN2015/088515 | | 8/2015 |

* cited by examiner

DRIVING METHODS OF POLARITY INVERSION OF LIQUID CRYSTAL PANELS

BACKGROUND OF THE INVENTION

1. Field of the Invention

The present disclosure relates to liquid crystal display technology, and more particularly to a driving method of polarity inversion of liquid crystal panels.

2. Discussion of the Related Art

Image sticking (IS) a common issue on liquid crystal devices (LCDs). The liquid crystal molecules may be twisted due to the electrical field caused by direct current (DC), and then polar electrical fields are generated. This may cause biased DC, and may results in IS issue. Usually, the voltage driving methods of positive/negative polarity inversion are adopted to overcome this issue. However, as the material may cause pollution, inefficient manufacturing process, or other issues, the IS issue may still happen when static images have been displayed for a long period of time.

In addition, when the LCD is driven by the voltage driving method of positive/negative polarity inversion of a fixed common voltage (VCOM), as the positive voltage and the negative voltage of the VCOM of some locations are asymmetric, the liquid crystal panel may flicker. With respect to this issue, Multi-VCOM solution has been developed, and different VCOM are configured to drive different areas of the liquid crystal panel. However, the cost of adopting such technology is still high.

SUMMARY

In order to overcome the above problems, the present disclosure relates to a driving method of polarity inversion of liquid crystal panels for enhancing the IS issues when the liquid crystal panel displays the images.

In one aspect, a driving method of polarity inversion of liquid crystal panels includes:

driving sub-pixels within a predetermined area of the liquid crystal panel by a period having m number of consecutive frames, and m is an integer larger than four; and wherein polarity of sub-pixel driving voltage of a first predetermined number of consecutive frames among the m number of frames being the same, and the polarity of the sub-pixel driving voltage of the frames other than the first predetermined number of consecutive frames being opposite to the polarity of the sub-pixel driving voltage of the adjacent frames.

Wherein: when the first predetermined number is even, m is an odd number larger than the first predetermined number; and when the first predetermined number is odd, m is an even number larger than the first predetermined number.

Wherein the predetermined area is the whole area of the liquid crystal panel.

Wherein the predetermined area is one area within a plurality of areas of the liquid crystal panel.

Wherein the sub-pixels within another area of the plurality of areas of the liquid crystal panel are driven by the period having n number of consecutive frames, and n is an integer larger than four; and wherein the polarity of the sub-pixel driving voltage of the second predetermined number of consecutive frames among the n number of frames are the same, and the polarity of the sub-pixel driving voltage of the frames other than the second predetermined number of consecutive frames is opposite to the polarity of the sub-pixel driving voltage of adjacent frames.

Wherein: when the second predetermined number is even, m is an odd number larger than the second predetermined number; and when the second predetermined number is odd, m is an even number larger than the second predetermined number.

Wherein when m equals with n, the polarity of the sub-pixel driving voltage of the i-th frame of the m number of the consecutive frames is opposite to the polarity of the sub-pixel driving voltage of the i-th frame of the n number of the consecutive frames, and wherein $i \in [1, m]$.

Wherein: under the condition that the first predetermined number is two and m equals 5 and the second predetermined number is two and m equals 5, the polarity of the sub-pixel driving voltage of the five consecutive frames within one area are positive, negative, positive, positive, and negative, and the polarity of the sub-pixel driving voltage of the five consecutive frames within another area may be negative, positive, negative, negative, and positive; or under the condition that the first predetermined number is two and m equals 5 and the second predetermined number is two and m equals 5, the polarity of the sub-pixel driving voltage of the five consecutive frames within one area are negative, positive, negative, negative, and positive, and the polarity of the sub-pixel driving voltage of the five consecutive frames within another area are positive, negative, positive, positive, and negative.

In view of the above, the driving method not only can eliminate the IS issue, but also can eliminate the flicker issue at the same time.

In order to further understand the characteristics of the invention as well as technical content, see the following detailed description of the present invention and the accompanying drawings, drawings, however, for reference purposes only and description of use is not intended to limit the present invention.

BRIEF DESCRIPTION OF THE DRAWINGS

Below in conjunction with the accompanying drawings, through a specific embodiment of the present invention is described in detail, and will make apparent the technical solution of the present invention, and other beneficial effects.

DETAILED DESCRIPTION OF THE EMBODIMENTS

Figure 1:
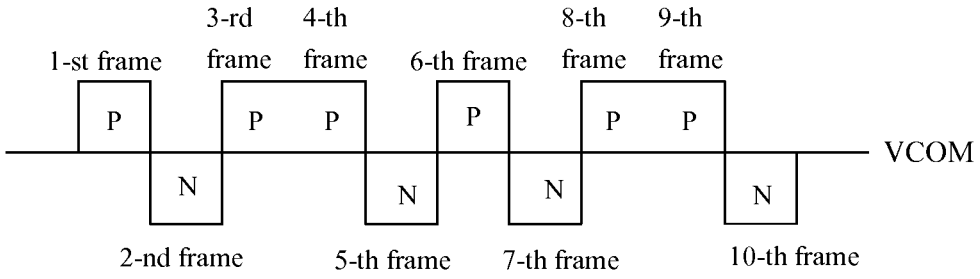
FIG. 1 is a sectional view of the polarity change of a portion of frames of the driving voltage of the sub-pixel within an area among a plurality of areas of the liquid crystal panel in accordance with one embodiment.

Embodiments of the invention will now be described more fully hereinafter with reference to the accompanying drawings, in which embodiments of the invention are shown.

In the embodiment, the driving method of the positive/negative polarity inversion of the liquid crystal panels may be adopted to drive sub-pixels within a predetermined area of the liquid crystal panel for a consecutive period equaling to m number of frames. That is, the sub-pixels of the predetermined areas of the liquid crystal panel may be driven in accordance with the polarity of the sub-pixel driving voltage of each frame of the m number of frames recurrently. In an example, m is an integer larger than four.

Here, m is an integer larger than four. The polarity of the sub-pixel driving voltage of the first predetermined number of consecutive frames among the m number of frames are the same. The polarity of the sub-pixel driving voltage of the frames other than the first predetermined number of frames is opposite to the polarity of the sub-pixel driving voltage of the adjacent frames. Here, the liquid crystal panel may be any kind of liquid crystal panels. The first predetermined number of consecutive frames having the same polarity of the sub-pixel driving voltage may be arranged in any locations of the m number of frames. Preferably, the first predetermined number of consecutive frames may be arranged in the last frame of the m number of frames.

It can be understood that the first predetermined number is an integer larger than one. For instance, the first predetermined number may be two. That is, the first predetermined number may be configured accordingly. When the first predetermined number is even, m is an odd number larger than the first predetermined number. When the first predetermined number is odd, m is an even number larger than the first predetermined number. It can be understood that the value of m may be selected by experiments, or be calculated by theory.

The predetermined area may be a complete area of the liquid crystal panel. That is, all of the sub-pixels are driven by the same period, i.e., the same consecutive m number of frames, so as to become the driving method of the positive/negative polarity inversion in the embodiments.

In addition, the predetermined area may be one of the area among the plurality of areas of the liquid crystal panel. At this moment, the sub-pixels within other areas of the liquid crystal panel may be driven by other conventional methods.

In an example, the sub-pixels in another area of the liquid crystal panel may be driven by the period of consecutive n number of frames. Here, n is an integer larger than four. The polarity of the sub-pixel driving voltage of the second predetermined number of consecutive frames among then number of frames are the same. The polarity of the sub-pixel driving voltage of the frames other than the second predetermined number of consecutive frames is opposite to the polarity of the sub-pixel driving voltage of the adjacent frames.

The second predetermined number of consecutive frames having the same polarity of the sub-pixel driving voltage may be arranged in any locations of the m number of frames. Preferably, the first predetermined number of consecutive frames may be arranged in the last frame of the m number of frames.

It can be understood that the second predetermined number is an integer larger than one. For instance, the second predetermined number may be two. That is, the second predetermined number may be configured accordingly. When the second predetermined number is even, n is an odd number larger than the second predetermined number. When the second predetermined number is odd, n is an even number larger than the second predetermined number. It can be understood that the value of m may be selected by experiments, or be calculated by theory.

Here, n may be equal to or different from m. The second predetermined number may be equal to or different from the first predetermined number. The location of the second predetermined number of consecutive frames having the same polarity of sub-pixel driving voltage may be arranged at the location among the n number of the frames that is the same with or different from that location of the first predetermined number of consecutive frames among the m number of the frames.

In an example, when m equals with n, the polarity of the sub-pixel driving voltage of the i-th frame of the m number of the consecutive frames is opposite to the polarity of the sub-pixel driving voltage of the i-th frame of the n number of the consecutive frames. Here, $i \in [1, m]$.

In other words, the polarity of the sub-pixel driving voltage of each of the frames of the n number of the consecutive frames is opposite to the polarity of the sub-pixel driving voltage of the corresponding frame of the m number of the consecutive frames.

For instance, under the condition that the first predetermined number is two and m equals 5 and the second predetermined number is two and m equals 5, the polarity of the sub-pixel driving voltage of five consecutive frames within one area may be positive, negative, positive, positive, and negative, as shown in FIG. 1. The polarity of the sub-pixel driving voltage of five consecutive frames within another area may be negative, positive, negative, negative, and positive, as shown in FIG. 1.

FIG. 1 is a sectional view of the polarity change of a portion of frames of the driving voltage of the sub-pixel within an area among a plurality of areas of the liquid crystal panel in accordance with one embodiment. In FIG. 1, only the polarity of the sub-pixel driving voltage of each frame for 10 frames, that is, two periods. It can be understood that the present disclosure is not limited to the above example. As shown in FIG. 1, the polarity of the sub-pixel driving voltage above the VCOM line is positive, and the polarity of the sub-pixel driving voltage below the VCOM line is negative.

Figure 2:
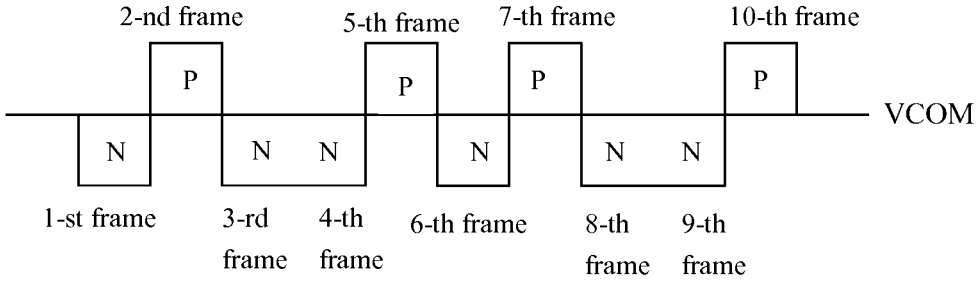
FIG. 2 is a sectional view of the polarity change of a portion of frames of the driving voltage of the sub-pixel within another area among a plurality of areas of the liquid crystal panel in accordance with one embodiment.

FIG. 2 is a sectional view of the polarity change of a portion of frames of the driving voltage of the sub-pixel within another area among a plurality of areas of the liquid crystal panel in accordance with one embodiment. In FIG. 2, only the polarity of the sub-pixel driving voltage of each frame for 10 frames, that is, two periods. It can be understood that the present disclosure is not limited to the above example. As shown in FIG. 2, the polarity of the sub-pixel driving voltage above the VCOM line is positive, and the polarity of the sub-pixel driving voltage below the VCOM line is negative.

In addition, under the condition that the first predetermined number is two and m equals 5 and the second predetermined number is two and m equals 5, the polarity of the sub-pixel driving voltage of five consecutive frames within one area may be negative, positive, negative, negative, and positive. The polarity of the sub-pixel driving voltage of five consecutive frames within another area may be positive, negative, positive, positive, and negative.

It can be understood that other areas except for the above areas of the liquid crystal panel may be driven by other conventional driving methods basing on the real scenarios. When the plurality of the areas means two areas, one of the area includes the sub-pixels in the odd rows of the liquid crystal panel, and "another area" means the sub-pixels in the even rows of the liquid crystal panel, wherein the row inversion driving method is implemented.

When the plurality of the areas means two areas, one of the area includes the sub-pixels having an odd sum of the row number and the column number, and "another area'" includes the sub-pixels having an even sum of the row number and the column number, wherein the row inversion driving method is implemented.

When the plurality of the areas means two areas, one of the area includes the sub-pixels in the odd columns of the liquid crystal panel, and "another area" means the sub-pixels in the even columns of the liquid crystal panel, wherein the column inversion driving method is implemented.

In view of the above, by adding a predetermined number of frames having positive or negative driving voltage within one period to compensate the biased DC caused by various reasons. In this way, the IS issue may be overcame. In addition, the flicker issue may also be overcame by driving the different areas with different periods and polarity.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving method of polarity inversion of liquid crystal panels, comprising:

driving sub-pixels within a predetermined area of the liquid crystal panel by a period having m number of consecutive frames, and m is an integer larger than four; and wherein polarity of sub-pixel driving voltage of a first predetermined number of consecutive frames among the m number of frames being the same, and the polarity of the sub-pixel driving voltage of the frames other than the first predetermined number of consecutive frames being opposite to the polarity of the sub-pixel driving voltage of the adjacent frames; and when the first predetermined number is even, m is an odd number larger than the first predetermined number; and when the first predetermined number is odd, m is an even number larger than the first predetermined number.

2. The driving method as claimed in claim 1, wherein the predetermined area is the whole area of the liquid crystal panel.

3. The driving method as claimed in claim 1, wherein the predetermined area is one area within a plurality of areas of the liquid crystal panel.

4. The driving method as claimed in claim 3, wherein the sub-pixels within another area of the plurality of areas of the liquid crystal panel are driven by the period having n number of consecutive frames, and n is an integer larger than four; and wherein the polarity of the sub-pixel driving voltage of the second predetermined number of consecutive frames among the n number of frames are the same, and the polarity of the sub-pixel driving voltage of the frames other than the second predetermined number of consecutive frames is opposite to the polarity of the sub-pixel driving voltage of adjacent frames.

5. The driving method as claimed in claim 4, wherein:

when the second predetermined number is even, m is an odd number larger than the second predetermined number; and when the second predetermined number is odd, m is an even number larger than the second predetermined number.

6. The driving method as claimed in claim 5, wherein when m equals with n, the polarity of the sub-pixel driving voltage of the i-th frame of the m number of the consecutive frames is opposite to the polarity of the sub-pixel driving voltage of the i-th frame of the n number of the consecutive frames, and wherein $i \in [1, m]$.

7. The driving method as claimed in claim 6, wherein:

under the condition that the first predetermined number is two and m equals 5 and the second predetermined number is two and m equals 5, the polarity of the sub-pixel driving voltage of the five consecutive frames within one area are positive, negative, positive, positive, and negative, and the polarity of the sub-pixel driving voltage of the five consecutive frames within another area may be negative, positive, negative, negative, and positive; or under the condition that the first predetermined number is two and m equals 5 and the second predetermined number is two and m equals 5, the polarity of the sub-pixel driving voltage of the five consecutive frames within one area are negative, positive, negative, negative, and positive, and the polarity of the sub-pixel driving voltage of the five consecutive frames within another area are positive, negative, positive, positive, and negative.

* * * * *